United States Patent [19]

Doolan

[11] Patent Number: 4,720,127

[45] Date of Patent: Jan. 19, 1988

[54] DOOR LATCH

[75] Inventor: Martin P. Doolan, Duncanville, Tex.

[73] Assignee: Sunwest International Trading Co., Inc., Duncanville, Tex.

[21] Appl. No.: 48,049

[22] Filed: May 15, 1987

[51] Int. Cl.[4] ..... E05C 1/16

[52] U.S. Cl. ..... 292/169.22; 292/DIG. 26

[58] Field of Search ..... 292/150, 169.19, 169.22, 292/352, 359, DIG. 26

[56] References Cited

U.S. PATENT DOCUMENTS

| | | | |
|---|---|---|---|
| 1,688,240 | 10/1928 | Keigwin | 292/359 |
| 2,390,756 | 12/1945 | Voight | 292/169.22 X |
| 2,420,114 | 5/1947 | Van der Henst | 292/169.22 X |
| 2,723,874 | 11/1955 | Hillgren | 292/359 X |
| 2,743,600 | 5/1956 | Heyer | 292/169.19 X |

*Primary Examiner*—Richard E. Moore

*Attorney, Agent, or Firm*—Kanz, Scherback & Timmons

[57] ABSTRACT

A door latch includes an elongated stationary case and a latch bolt mounted to reciprocate longitudinally in the case between outwardly extended and inwardly retracted positions. The latch bolt is driven between the two positions by a driver mechanically connected to the latch bolt and longitudinally movable within the case under control of first and second cams. The rotation of either cam will cause the driver to move in direction to pull the latch bolt to in inwardly retracted position. A pushbutton key is mounted to a sidewall of the case and movable in direction into and out of the case to lock one of the cams against rotation. The key is mounted to a pin which is received by a camming means on the other cam whereby rotation of the other cam will move the pin in direction to retract the key from the first mentioned cam. A spindle for rotating the cams is comprised of first and second segments in end butting relation and rotatable with respect to each other. The cams may be rotated independently of each other by associating the cams individually with one or the other of the segments.

10 Claims, 7 Drawing Figures

DOOR LATCH

BACKGROUND OF THE INVENTION

The present invention is directed generally to the door lock and latch mechanism arts, and more particularly to a unique operator comprised of two cams, each individually operated to cause a latch bolt to move between outwardly extended and inwardly retracted positions.

Door latch assemblies are available to enable one to lock and to release the assembly from one side of a door utilizing a push button key. These latches find use with bathroom and bedroom doors. For the most part, these assemblies possess the desireable features of movement of the door handles or knobs independently of one another and also provide for release of the locking mechanisms by rotation of the inner door handle or knob in either clockwise or counterclockwise direction. Door latches possessing these features are, however, for the most part complex, expensive to manufacture and difficult to install. Moreover, presently available door latches with the push button key locking feature, for use on bathroom or bedroom doors, are comprised of mechanisms which as a whole do not lend themselves to repair, such that upon the occurrence of a fault or a breakdown of the mechanism, it is necessary to replace the entire assembly. Other door latches of more simple construction do not possess the locking feature.

OBJECTS AND SUMMARY OF THE INVENTION

Accordingly, it is an object of the present invention to provide a door latch easy to manufacture, simple to install, and reliable in operation. It is another object of the present invention to provide for ready replacement of component parts of the latch should any one of them become faulty and thus enable repair to be effected without the necessity of replacing the entire door latch assembly.

It is yet another object of the present invention to provide a door latch having a security feature including a push button key which may be locked from the inside of a room and the lock released by rotation of the door handle in either direction and thus avoid panic on the part of the occupant of the room, particularly among the young, infirmed or handicapped. It is still another object of the present invention to provide a latch assembly which can accommodate different forms of door handles, whether they be doorknobs or levers.

The aforesaid objects of the present invention are met by providing a door latch having an elongated stationary case. A latch bolt is mounted to reciprocate longitudinally in the case between outwardly extended and inwardly retracted positions. An operator within the case is rotatable about an axis extending transversely through the case to cause a driver to move the latch bolt longitudinally in response to rotation of the operator. The operator is comprised of a first cam and a second cam, each having top and bottom portions engaging the driver to enable the driver by rotation of the operator in either a clockwise or counterclockwise direction. A push button key is provided moveably mounted to a sidewall of the case and moveable in the direction into and out of the case without engaging the second cam. The first cam has a portion for receiving at least a part of the push button key for locking the first cam against rotation when the key is in the receiving portion. With the key in the receiving portion, the first cam is locked against rotation and therefore the door latch cannot be operated from the outside of the door to which the latch is mounted. The second cam has a camming means formed in the surface adjacent the sidewall of the case and receives a pin mounted on the push button key such that the rotation of the second cam will engage the pin and move the push button key out of the receiving portion of the first cam. This effectively unlocks the door and permits the opening and closing of the door from either side.

Another feature of the present invention is a segmented spindle for rotating said cams. The spindle is comprised of first and second segments in end butting relation and rotatable with respect to each other. The first segment of the spindle engages only the first cam and the second segment of the spindle engages only the second cam and thus provides for independent operation of each of the cams for moving the latch bolt between the outwardly extended and inwardly retracted positions.

The elongated stationary case which receives the operator and the driver comprises two halves which are secured together by at least one machine screw to provide for easy assembly and disassembly of the case to enable access to its interior for repair or replacement as need be of parts within the case.

DESCRIPTION OF THE DRAWINGS

The foregoing, as well as other objects, features and advantages of the invention will be more readily appreciated upon consideration of the following detailed description of the illustrated embodiment, together with the accompanying drawing wherein.

DETAILED DESCRIPTION OF THE ILLUSTRATED EMBODIMENT

Figure 1:
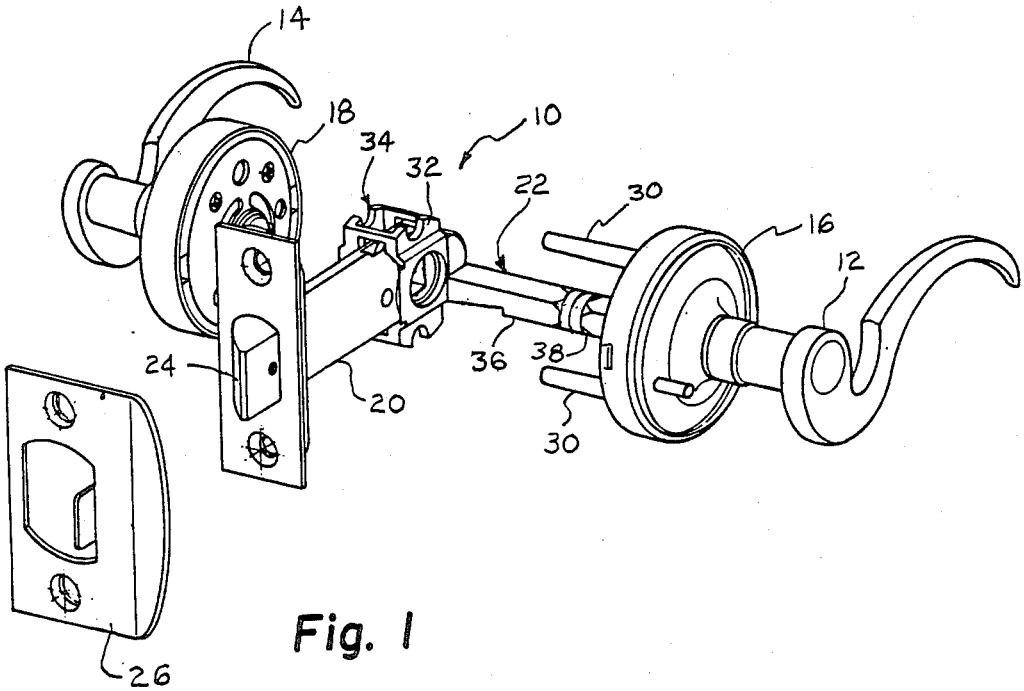
FIG. 1 an exploded perspective view of a door latch assembly embodying the present invention.

Referring now to the drawings and initially to FIG. 1, a door lever or knob assembly embodying features of the present invention is designated 10. The assembly includes door handle or knob 12 intended for placement on one side of a door and door handle or knob 14 intended to be placed on an opposite side of the door. Associated with the handles or knobs 12 and 14 respectively are escutcheon plates 16 and 18. The latching mechanism is contained within case 20 through which a spindle 22 passes into engagement with an operator (not shown) to move latch bolt 24 and cause it to reciprocate longitudinally in the case 20 between outwardly extended and inwardly retracted positions and cause the bolt to engage or disengage striker plate 26. Associated with handle 12 and escutcheon plate 16 are a pair of spaced parallel rods 30 which are internally threaded to receive machine screws associated with the escutcheon plate 18 for securing the assembly to a door. A guide means 32 is slidably mounted on the exterior of the case 20 but to enable the easy location of the machine screws relative to the rods 30. This is effected by having surface 34 of guide means 32 lie in the same plane as the ends of the rods 30. The result is a fairly broad solid contact area substantially surrounding the threaded openings in the rods 30. The ends of the machine screws will contact area and be limited in movement to avoid passing the ends of rods 30 and thus enabling the movement of the end of each machine screw into engagement with the threaded opening of its respective rod 30. The guide 32 is preferably made of plastic.

Segments 36 and 38 of spindle 22 are in end butting relation and secured for relative rotation one with respect to the other. Thus when the door latch assembly is mounted in the door, the first segment 36 only of spindle 22 will be operated by the door handle 14 to move the latch bolt inwardly and outwardly and the second segment 38 of the spindle 22 will be effective in conjunction with the handle 12 only to move the latch bolt inwardly and outwardly with respect to the case 20.

Figure 2:
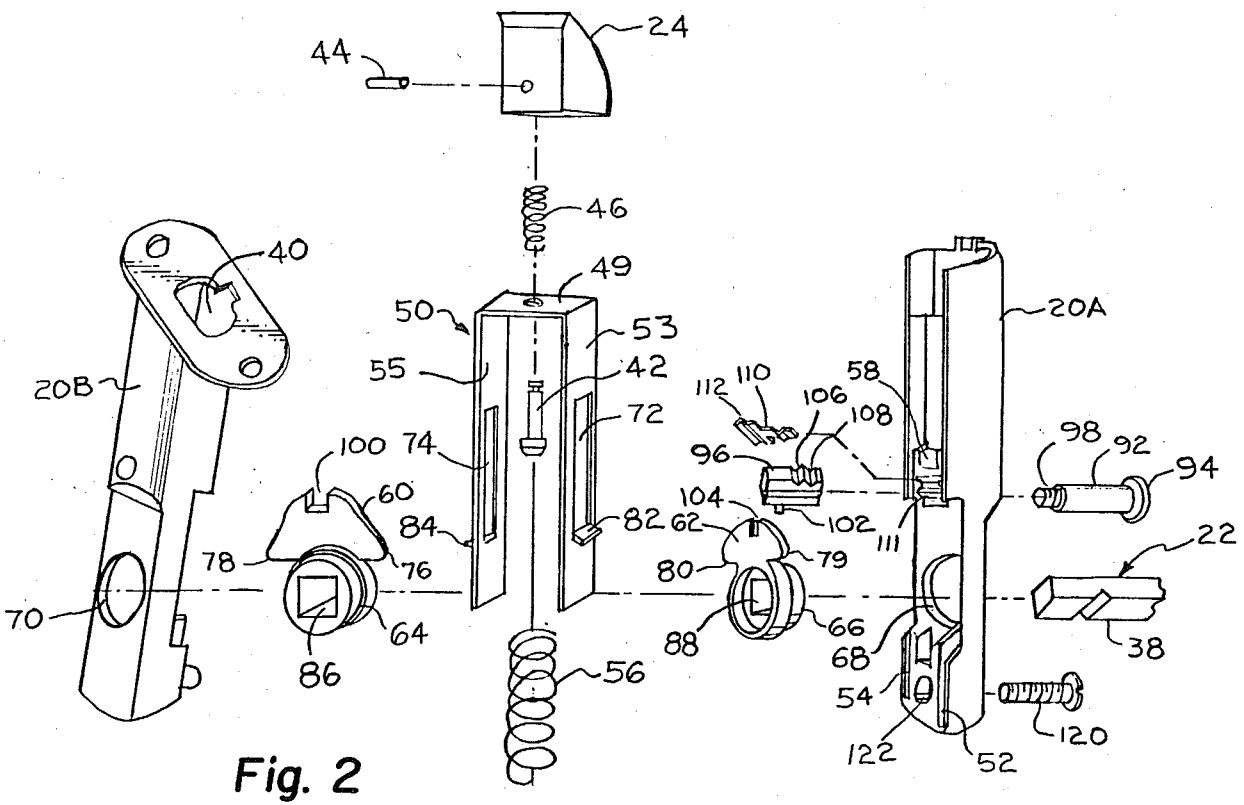
FIG. 2 is an exploded view of the latch mechanism embodying features of the present invention.

Referring now to FIG. 2, the case 20 of FIG. 1 is shown comprised of two elongated halves 20A and 20B. An aperture 40 at the end of case half 20B receives the latch bolt 24 which is secured to one end of lever pin 42 by pin 44. A compression spring 46 surrounds pin 42 and urges the latch bolt 24 away from base 49 of a U-shaped latch slide 50 which is mounted for reciprocating motion within the case 20. Movement of the latch slide is guided by grooves 52, 54 which extend along the lengths of the halves 20A, 20B of case 20. The latch slide 50 is urged forward in the case 20 by way of helical spring 56, one end of which is in contact with the under surface of the base 49 of the latch slide 50 and the other end of which engages a shoulder 58 formed in the latch case portion 20A. With the latch slide 50 in its forward position, the latch bolt 24 is in an outwardly extended position as shown in FIG. 1. When the latch slide 50 is moved in an opposite direction within the case 20, it will draw or drive the latch bolt 24 to an inwardly retracted position. The driver comprised of the latch slide 50 is moved in the rearward direction by an operator comprised of cams 60 and 62. Each of the cams 60, 62 has a hub of circular outer configuration. More specifically, cam 62 has hub 68 received by a circular hole 68 passing through the sidewall of casing part 20A and cam 60 has hub 64 received by a circular hole or aperture 70 passing through the casing part 20B. The cams 60, 62 are rotatable about an axis extending transversely through the case 20.

The latch slide 50 has legs 53 and 55 respectively provided with longitudinal slots 72 and 74 which receive top portion 76 and bottom portion 78 of cam 60 and top portion 78 and bottom portion 80 of cam 62. The top and bottom portions of the cams 60 and 62 extend respectively into and through the slots 72 and 74 beyond the outer surfaces of legs 53 and 55 to engage shoulders 82 and 84 formed respectively at the rearward ends of the slots 72 and 74 to provide a camming action. The rotation of either of the cams 60 or 62 on their respective hubs will cause the latch slide 50 to be moved to its retracted position, moving the latch bolt 24 to its inwardly retracted position.

The body portion of each of the cams 60 and 62 are respectively provided with noncircular holes 86 and 88 which extend through the hubs 64 and 66 to receive the spindle 22. In the commercial embodiment of the present invention, the holes 86 and 88 are of square configuration matching the square cross section of the spindle 22. When the spindle 22 is in position, the segment 36 engages only the cam 60 and the segment 38 engages only the cam 62 such that the cams 60 and 62 are individually and independently rotated about their respective hubs 64 and 66. The individual rotation of the cams is made possible by a feature of the present invention in which the segments 36 and 38 of the spindle 22 are rotatable, one with respect to the other. Upon operation of a door handle 12 in FIG. 1, only the segment 38 is rotated effecting rotation in turn of the cam 62. The rotation of the segment 36 by way of the handle 14 of FIG. 1 will rotate only the cam 60. The rotation of either one of the cams will effect a retraction or longitudinal movement of the latch slide 50 within the casing 20 to move the latch bolt to its inwardly retracted position.

The provision of two cams and a segmented spindle makes possible a locking and unlocking operation from only one side of a door to which the latching assembly is mounted. This feature or operation is provided in conjunction with the cams and spindle by a push button key comprised of the pushbutton 92 having an enlarged end 94 to be engaged by hand, either for moving the push button in or withdrawing the push button out, and a key 96 mounted for lateral movement within the casing 20. The key 96 is internally threaded at one end to receive a threaded portion 98 of the push button 92. When the push button 92 is moved inwardly, it moves the key 96 into engagement with a notch 100 formed in the end of the cam 60. In this position, the cam 60 is immobilized and the door handle on the outside of the door is ineffective to rotate the cam. The door is locked.

Release of the locked state is provided by way of a pin 102 received by a V-shaped groove 104 formed in the surface of cam 62 for providing a camming means or camming action which upon rotation of the cam 62 will move the key 96 from the receiving means or notch 100 of cam 60 to enable the rotation of the cam 60.

The key 96 is maintained in either an upper or lower position by way of lateral grooves 106 and 108 formed in the surface of the key cooperating with a flat spring 110 which is mounted in a receiving slot 111 in the case section 20A. The spring 110 includes a boss 112 which engages transverse slot 106 or 108 and thus locates the key 96 in either a locked or unlocked position.

The two halves 20A and 20B of the case 20 are secured together by the use of at least one machine screw 120 passing through the aperture 122 of the part 20A of case 20 and into a threaded portion (not shown) formed in the part 20B of the case 20.

It is apparent from the above construction and design that the removal of the machine screw 120 will permit the separation of the case halves 20A and 20B and thus enable one to gain access to the interior of the casing and to the various parts comprising the latch. Thus, if difficulty arises in the operation of the latch, such as the breaking of a part, one can readily gain access to the mechanism and substitute for that broken part with necessity of replacing the entire latch mechanism.

Figure 3:
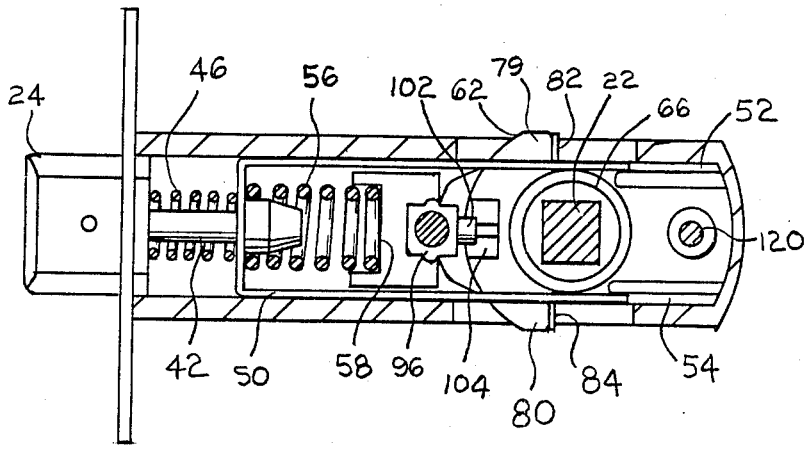
FIG. 3 is a partial cross section of the assembled latch mechanism with one side of the case removed.

Referring now to FIG. 3 where the latch mechanism is shown partially in cross section with case half 20A removed. As illustrated, the latch bolt 24 is in its outwardly extended position under influence of the spring 46 urging between the base of the latch bolt 24 and the base 49 of the latch slide 50. The latch slide 50 is in its forward position under the influence of spring 56, one end of which engages the shoulder 58 of the latch slide and the other end of which surrounds a portion of the lever pin 42 and engages the underside of the base of the U-shaped latch slide.

The upper and lower portions 78, 80 of cam 62 extend through the slots 72 and 74 (not shown), respectively, in the latch slide 50 above and below the latch slide to engage the shoulders 82 and 84 of the latch slide. Similarly, the upper and lower portions 76, 78 of cam 60, directly behind the like parts of cam 62 engage the shouldes 82 and 84 of the latch slide 50. With the latch in an unlocked condition, rotation of the spindle 22 in either direction, that is clockwise or counterclockwise, will cause the latch slide 50 to move to the right, guided in the grooves 52 and 54 formed in the portion or side part 20B of the case 20 and against the force of spring 56 to move the latch bolt inwardly by pulling on the enlarged head of the lever pin 42.

Figure 4A:
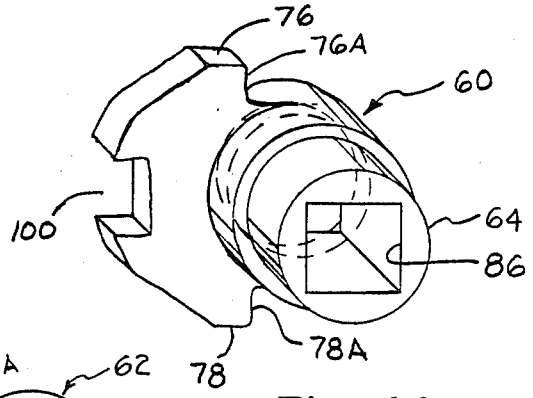
FIGS. 4A, 4B and 4C illustrate details of the cams comprising the operator.
Figure 4B:
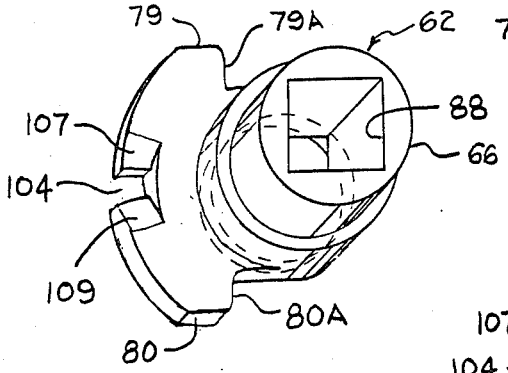
Figure 4C:
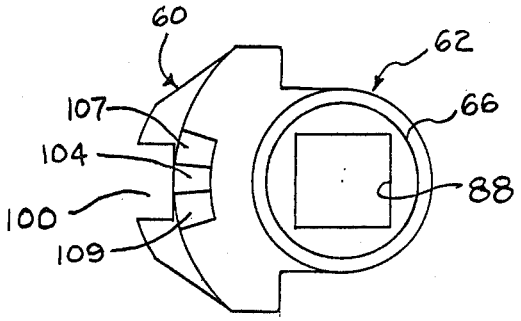

Further details of the cams 60 and 62 comprising the operator of the latch assembly are illustrated in FIGS. 4A, 4B and 4C. The outside cam 60, the cam adjacent the outside of a door, is shown in FIG. 4A to include the hub 64 of circular cross section and penetrated by an aperture 88 of square cross section to receive the spindle 22. The cam is provided with the diametrically opposed enlarged sections 76 and 78 whose rearward surfaces 76A and 78A provide the camming action by engaging the shoulders 82 and 84, respectively, of the latch slide 50 to move the latch slide longitudinally of the case 20 upon rotation of the cam 60. The cam 60 also is provided with the means for receiving at least a portion of the pushbutton key. This receiving means is provided by the notch 100 formed in the end of the cam 60.

The inside cam 62, the cam adjacent the inside of a door, is illustrated in greater detail in FIG. 4B. Like cam 60, cam 62 is provided with the enlarged upper portion 79 and the lower portion 80, the back surfaces of which respectively 79A and 80A will extend through the slots 72 and 74 of the latch slide 50 to engage respectively the shoulders 82 and 84 of the latch slide. The cam 62 includes the hub 66 of circular cross section and is pierced by a hole of square cross section to receive one of the segments 36 or 38 of the spindle 22.

A forward end of the cam 62 is provided with a V-shaped groove 104 to receive the pin 102 of the key 96. The base of the groove 104 is relieved at 105. The V-shaped groove provides two inclined camming surfaces 107 and 109 such that upon rotation of the cam 62 the pin 102 will ride up on either one of the two inclined surfaces of the groove, depending upon the direction of rotation of the cam. Upward movement of pin 102 moves the key 96 out of the notch 100 in cam 60, thus freeing the cam 60 for rotation and thus the operation of the latch assembly.

The relative positions of the cams 60 and 62 when mounted within the casing 20 is best illustrated in FIG. 4C. This figure illustrates the relative sizes of the cams, particularly the forward portions thereof. It will be noted that the notch 100 of cam 60 is beyond the end of cam 62 and located such that movement of the push button key laterally within the case 20 will not contact the forward portion of the cam 62. The pin 102 mounted to the key 96 will extend over the cam 62 toward its hub 66 and over the camming means or V-shaped groove formed in the forward portion of the cam 62.

Figure 5:
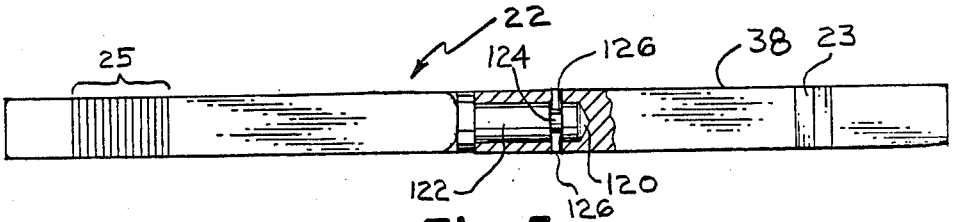
FIG. 5 is a front elevation, partially in cross section, of a spindle embodying a feature of the present invention.

The spindle 22 is illustrated in greater detail in FIG. 5 with portions of the spindle shown in cross section. As illustrated, segment 36 is provided with a cavity 120 bored into the end thereof and segment 38 has an end portion 122 of reduced circular cross section for insertion into the cavity 120. A groove 124 is formed intermediate the ends of the reduced portion 122 to receive one or more locking pins 126 which secure the two segments 36 and 38 together in rotational relationship.

The segment 38 is provided with a V-shaped groove to receive a set screw securing the handle or knob of the assembly to the spindle. On the other hand, the segment 36 is provided with a plurality of adjacent grooves also to receive a set screw of the other knob or handle. The plurality of grooves is provided in order to take into account door widths of different thickness over a prescribed range.

While the invention has been illustrated and described herein with reference to a specific preferred embodiment, the invention is not limited thereto. Those skilled in the art may devise various changes, alternatives and modifications upon reading the foregoing description. It is intended that the invention include such changes, alternatives and modifications insofar as they fall within the spirit and scope of the appended claims.

What is claimed is:

1. A door latch having an elongated stationary case, a latch bolt mounted to reciprocate longitudinally in said case between outwardly extended and inwardly retracted positions, an operator rotatable about an axis extending transversely through said case, a driver operable to move said latch bolt longitudinally in response to rotation of said operator, said operator comprising a first cam and a second cam, each having top and bottom portions engaging said driver to enable said driver by rotation of said operator in either a clockwise or counterclockwise direction, a push button key moveably mounted through a sidewall of said case and moveable in direction into and out of said case without engaging said second cam, said first cam having a portion for receiving at least a part of said push button key for locking said first cam against rotation when said key is in said receiving portion, said second cam having a camming means formed in a surface of said second cam adjacent said side wall of said case, said push button key including a pin mounted transversely of the movement of said key and extending beyond an end of said second cam for engagement with said camming means, whereby rotation of said second cam will move said push button key out of said receiving portion of said first cam to enable rotation of said first cam, and a spindle for rotating said cams comprised of first and second segments in end butting relation and rotatable with respect to each other, said spindle passing through said cams and said case with said first segment in engagement with said first cam and said second segment in engagement with said second cam.

2. The door latch of claim 1 in which each of said cams includes a circular hub extending through complementary holes in side walls of said case and each having noncircular holes passing through each hub and cam to receive said segments of said spindle.

3. The door latch of claim 1 in which said driver includes a latch slide connected in operable relation with said latch bolt and moveable longitudinally of said case under control of either said first cam or said second cam to move said latch bolt between said outwardly extended and inwardly retracted positions.

4. The door latch of claim 3 in which said latch slide is U shaped having leg portions, said case having grooves for receiving said leg portions of said slide to guide said slide in its longitudinal movement relative to said case.

5. The door latch of claim 4 in which said case is split longitudinally to provide two halves which are secured together by at least one machine screw to provide for easy disassembly of said case to enable access to the interior of said case for repair or replacement of parts contained within said case.

6. The door latch of claim 1 in which said segments of said spindle are of noncircular cross section, one of said segments provided with a cavity in one end thereof, the other of said segments having an end portion of reduced and circular cross section to be received by said cavity, said reduced end portion having a circumferential groove intermediate the ends thereof, and at least one pin extending through at least one side of said one of said segments and into said groove to lock said segments in end butting rotational relation.

7. The door latch of claim 4 in which said leg portions of said latch slide are provided with longitudinal slots, and each of said cams includes a circular hub and diametrically opposed portions providing said top and bottom portions extending beyond the diameter of its said hub and into said slots for engagement with said latch slide to impart movement to said latch slide and cause movement of said latch bolt toward a retracted position.

8. The door latch of claim 1 in which said receiving portion of said first cam comprises a notch in an end of said first cam extending toward said latch bolt and comfigured to receive said push button key.

9. The door latch of claim 1 in which said camming means comprises a V-shaped groove in a surface of said second cam facing said pin, said pin being received by said groove when a portion of said push button key is received by said first cam whereby rotation of said second cam will cause said pin to ride up on one of the surfaces of said V-shaped grove and move said portion of said push button key away from said first cam and free said first cam for rotation.

10. The door latch of claim 1 in which a flat spring is mounted to said case and includes a portion extending into the interior of said case, said portion of said spring including a boss, said push button key having two spaced transverse grooves for alternately receiving said boss to determine the limits of movement of said key.

* * * * *